United States Patent [19]

Ruggieri et al.

[11] Patent Number: 5,036,871

[45] Date of Patent: Aug. 6, 1991

[54] FLEXIBLE LANCE AND DRIVE SYSTEM

[75] Inventors: Steven K. Ruggieri, Marlborough; Stephen Jens, Ashland; Robert Sykes, Burlington, all of Mass.

[73] Assignee: Electric Power Research Institute, Inc., Palo Alto, Calif.

[21] Appl. No.: 314,091

[22] Filed: Feb. 22, 1989

[51] Int. Cl.[5] ..... B08B 3/02

[52] U.S. Cl. ..... 134/167 R; 134/177; 134/200; 239/753

[58] Field of Search ..... 239/DIG. 13, 588, 210, 239/195, 750, 752, 753; 134/175, 172, 177, 198, 200, 167 R; 165/11.1; 15/316 A

[56] References Cited

U.S. PATENT DOCUMENTS

| | | | |
|---|---|---|---|
| 2,668,978 | 2/1954 | DeMart | 239/753 X |
| 3,620,188 | 11/1971 | Schmitzer | 239/752 X |
| 4,107,001 | 8/1978 | Kinzler | 239/753 X |
| 4,343,211 | 8/1982 | Volle | 239/195 X |
| 4,424,769 | 1/1984 | Charamathieu et al. | 15/316 A |
| 4,638,667 | 1/1987 | Zimmer et al. | 165/11.1 |
| 4,646,768 | 3/1987 | Tanaka et al. | 134/172 X |
| 4,691,723 | 9/1987 | Mierswa et al. | 239/DIG. 13 X |
| 4,715,324 | 12/1987 | Muller et al. | 134/172 X |

*Primary Examiner*—Frankie L. Stinson

*Attorney, Agent, or Firm*—Flehr, Hohbach, Test, Albritton & Herbert

[57] ABSTRACT

A flexible lance and drive system (10) extends through manhole (12) into blow down lane (14) of a pressurized water reactor (PWR) steam generator secondary side assembly (16). The system (10) includes a support rail (18) passing through the manhole (12) and along the blow down lane (14). A transporter (20) is suspended for locomotion along the support rail (18). A flexible lance (24) extends through the transporter (20) and can be driven by the transporter into tube bundle (26) to a greater or lesser extent as required to observe and/or clean sludge deposits (28) within the tube bundle (26). High pressure hoses (34), nitrogen purge line (36) and Fiber optics cable (32) is supported by a spacerless hosebar structure (38). The hosebar structure (38) is integrally formed from a flexible plastic material in a single piece.

20 Claims, 3 Drawing Sheets

FLEXIBLE LANCE AND DRIVE SYSTEM

CROSS REFERENCE TO RELATED APPLICATIONS

This application, copending, commonly assigned U.S. patent application Ser. No. 07/027,810, filed Mar. 18, 1987, now U.S. Pat. No. 4,827,953, and U.S. patent application Ser. No. 07/303,268, filed Jan. 27, 1989 pending, both titled "Flexible Lance for Steam Generator Secondary Side Sludge Removal," are directed to related inventions.

BACKGROUND OF THE INVENTION

1. Field of the Invention

The present invention relates generally to an improved form of the flexible lances and systems disclosed in the above related applications. More particularly, it relates to such a flexible lance and system in which performance of the lance and system is enhanced in the areas of strength and flexibility, durability, fluid delivery at high flow and pressure, access to a difficult to access gemometry and locomotion within the difficult to access geometry.

2. Description of the Prior Art

The flexible lances and systems in the above related applications represent a substantial improvement in the art for accessing and cleaning a difficult to access geometry, such as in sludge removal on the secondary side of pressurized water reactor (PWR) steam generators in the nuclear power industry. However, certain elements of the design disclosed in those applications are unforeseen characteristics of the steam generators and the sludge deposits in them resulted in less than optimum performance of those flexible lance and system designs, including strength, durability and flexibility of the flexible lance, the volume and pressure of water delivered through the lances and tight intertube clearance. In the previous designs, the systems performed their operations on the steam generators while positioned on the central blowdown pipe. This operation mode limited access to intertube columns near the manhole due to the length of the transporter. Viewing the "back side" of the tall sludge pile existing in the steam generator was difficult due to the low operating elevation of the system transporter.

SUMMARY OF THE INVENTION

Accordingly, it is an object of this invention to provide a flexible lance for accessing a difficult to access geometry with increased flexibility in its horizontal plane.

It is another object of the invention to provide such a flexible lance with an increased stiffness in its vertical plane.

It is a further object of the invention to provide such a flexible lance which is able to deliver an increased volume of cleaning liquid at an increased pressure.

It is still another object of the invention to provide such a flexible lance which has increased durability as a result of its simplified construction.

It is yet another object of the invention to provide a system incorporating such a flexible lance which is able to access portions of a difficult to access geometry that are located adjacent to an access opening to the geometry.

It is a still further object of the invention to provide such a system with an increased ability to view a back side of a tall sludge deposit in the difficult to access geometry.

The attainment of these and related objects may be achieved through use of the novel flexible lance and drive system herein disclosed. A flexible lance in accordance with this invention has an integrally formed support comprising a pair of flexible, longitudinally extending strips and a plurality of bars joining the pair of strips. The plurality of bars each have at least one correspondingly positioned aperture. At least one fluid carrying hose extends along the pair of strips through the apertures of the plurality of bars.

A drive system in accordance with this invention has a flexible means for accessing an assembly having a difficult to access geometry and a transporter for the flexible means for accessing. A means in the transporter extends the flexible means for accessing from the transporter. A drive rail extends from an access hole of the difficult to access geometry. A transporter drive means is connected between the transporter and the drive rail.

The attainment of the foregoing and related objects, advantages and features of the invention should be more readily apparent to those skilled in the art, after review of the following more detailed description of the invention, taken together with the drawings, in which:

DETAILED DESCRIPTION OF THE INVENTION

Figure 1:
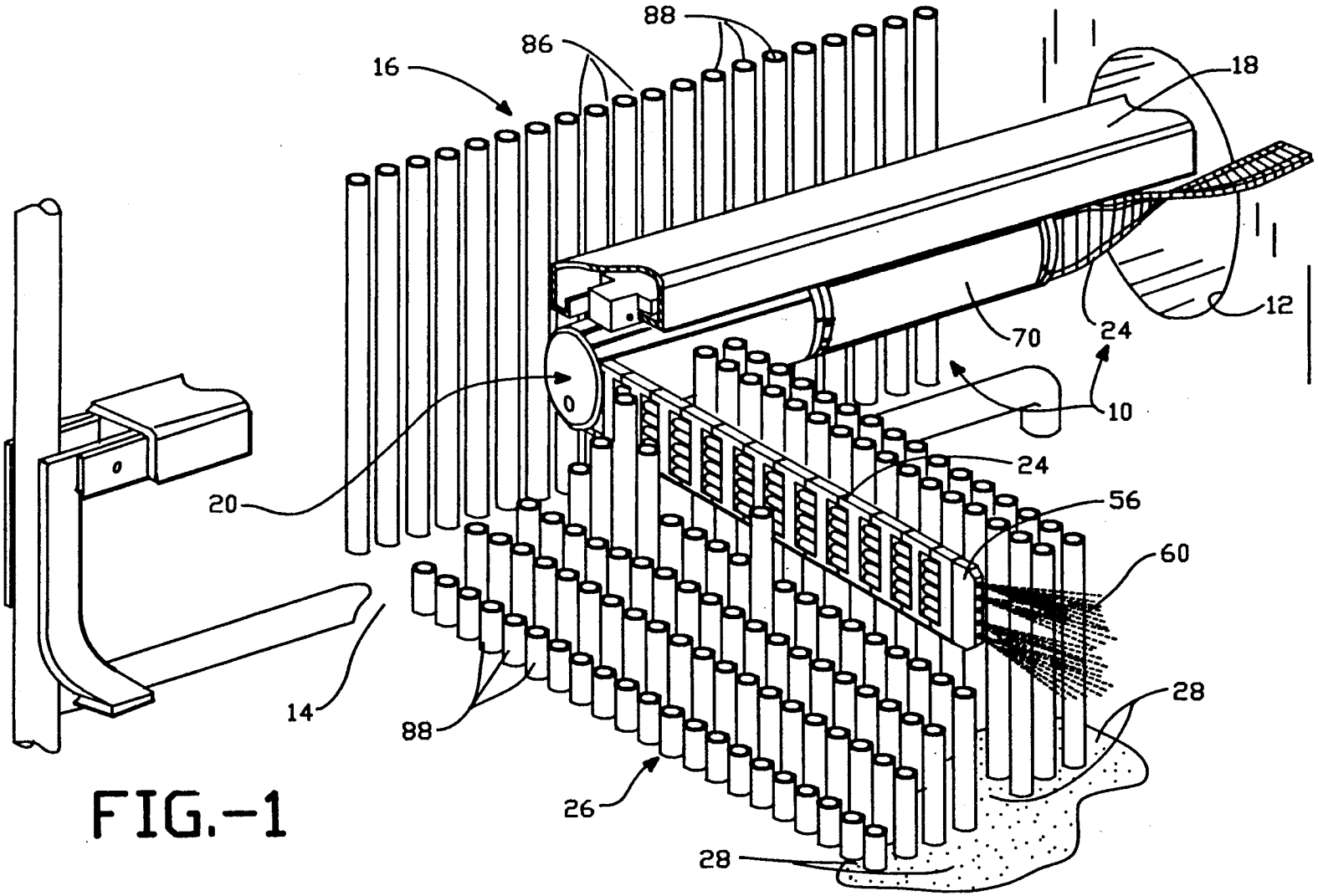
FIG. 1 is a perspective view of a flexible lance and drive system in accordance with the invention in use.

Turning now to the drawings, more particularly to FIG. 1, there is shown in a flexible lance and drive system 10 of this invention extending through manhole 12 into blow down lane 14 of a PWR steam generator secondary side assembly 16. The system 10 includes a support rail 18 passing through the manhole 12 and along the blow down lane 14. A transporter 20 is suspended for locomotion along the support rail 18. A flexible lance 24 extends through the transporter 20 and can be driven by the transporter into tube bundle 26 to a greater or lesser extent as required to observe and/or clean sludge deposits 28 within the tube bundle 26.

Figure 3:
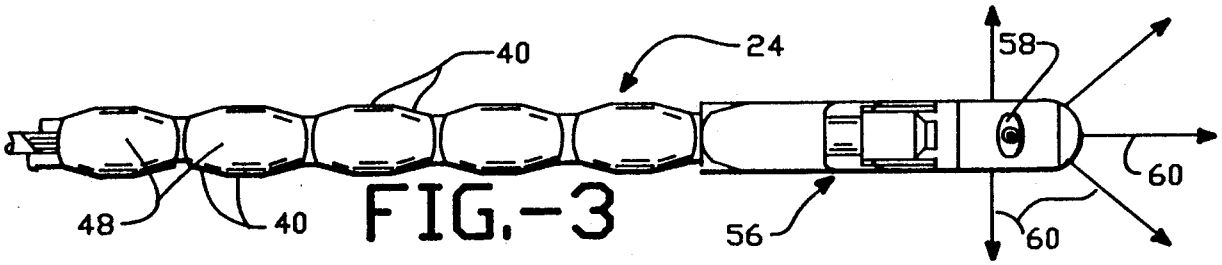
FIG. 3 is a top view of the flexible lance of FIG. 2.
Figure 2:
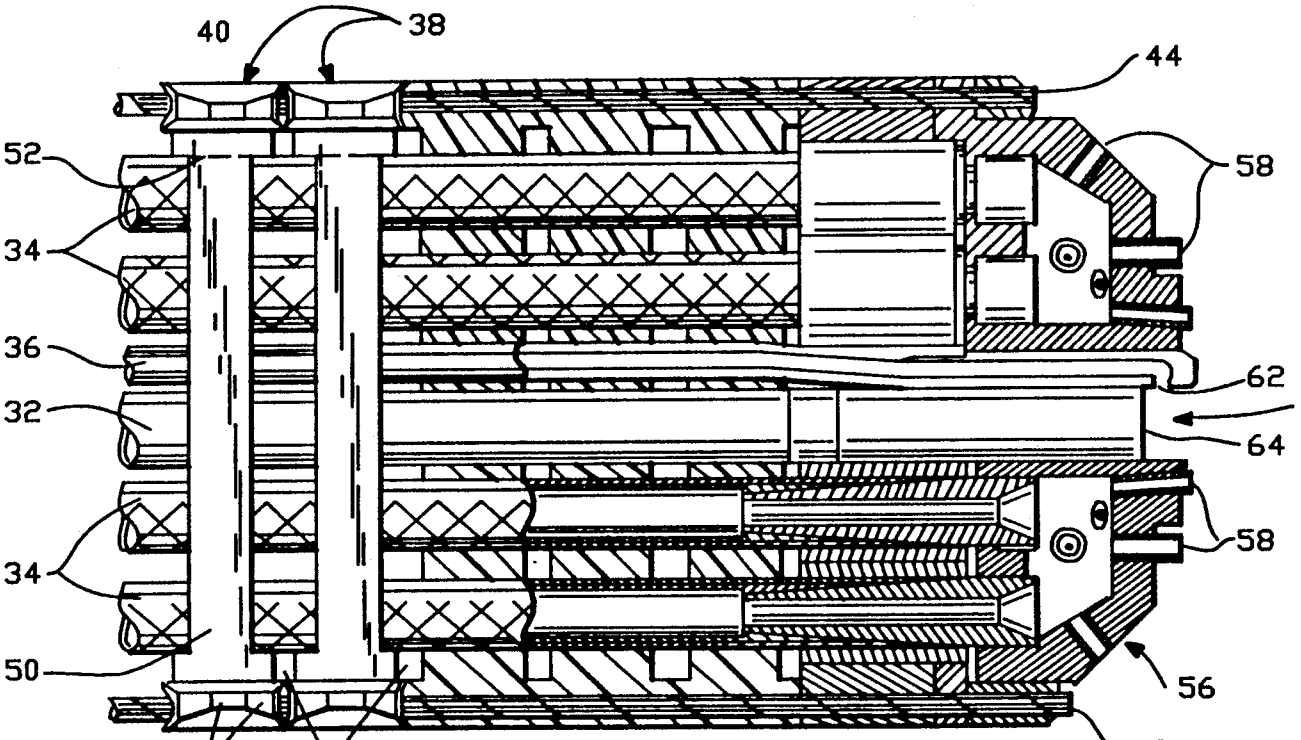
FIG. 2 is a side view of the flexible lance shown in FIG. 1.
Figure 4:
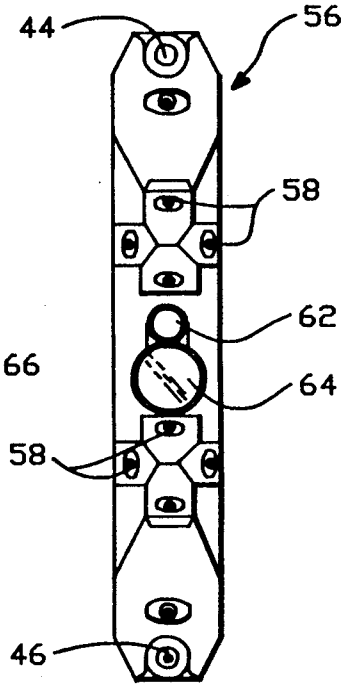
FIG. 4 is a front view of the flexible lance of FIGS. 2–3.

Details of the flexible lance 24 are shown in FIGS. 2–4. High pressure hoses 34, nitrogen purge line 36 and VideoProbe fiber optics cable 32 are supported by a plurality of separate spacerless hosebar structures 38. The hosebar structures 38 are integrally formed from a flexible plastic material, such as a hard nylon (available under the trademark Delrin) in a single piece. The hosebar structures include upper and lower, faceted, longitudinally extending separate, saceted shapes 48 defining strips 40 and 42 enclosing safety cables 44 and 46, which provide structural strength to the flexible lance 24. Each repeating faceted shape 48 of the strips 40 or 42 is connected to an opposing faceted shape 48 on the other strip 42 or 40 by a vertical bar 50. The vertical bars 50 have passages 52 through which the hoses 34 and line 36 pass. The vertical bars 50 define slots 54 beside the strips 40 and 42, which interact with sprocket wheels for driving the flexible lance 24 through the transporter 20.

End hosebar structure 38 is attached to a nozzle block 56 on the front of the flexible lance 24. The nozzle block 56 has a plurality of removable, precision machined, high pressure orifices 58 connected to the high pressure water hoses 34 to provide water jets 60 for removing the sludge deposits 28. The middle water jets 60 converge for maximum sludge removal effect. A nitrogen nozzle 62 is directed at lens 64 of VideoProbe camera system 66. The fiber optics cable 32 of the VideoProbe camera system 66 provides illumination from a remote light source for making an area adjacent to the nozzle block 56 inside the tube bundle 26 visible.

Figure 5:
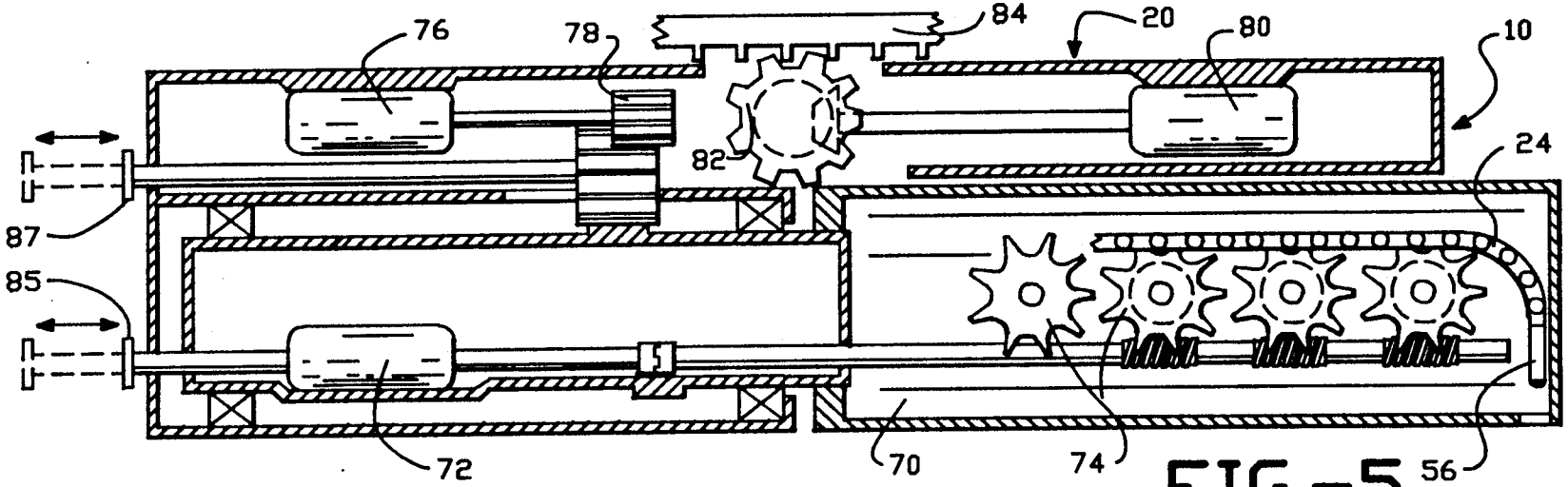
FIG. 5 is a side cross-section view of a portion of the flexible lance and drive system of FIGS. 1–4.

Details of the transporter 20 and the rail 18 to which it is attached for movement along the blown down tube 14 are shown in FIG. 5. The transporter 20 has a barrel 70 in which the flexible lance 24 is carried along the blow down lane and through which the flexible lance 24 is driven into the tube bundle 26. A lance drive motor 72 is connected to turn sprocket wheels 74 for advancing and retracting the flexible lance 24 in the barrel 70. The barrel 70 can be pivoted on its longitudinal axis through about 120° in order to provide different orientations of the flexible lance within the tube bundle 26. Tilt drive motor 76 is connected to the barrel 70 through gears 78 for this purpose. Drive motor 80 is connected to drive gears 82 for propelling the transporter 20 along the rail 18. The rail 18 has an integral gear rack 84 which meshes with the gears 82 for this purpose. The electric motors 72, 76 and 80 are all equipped with proportional speed control. Emergency releases 85 and 87 of a conventional nature are provided for the lance drive motor 72 and tilt drive motor 76. An emergency release (not shown) is also provided for the drive motor 80. These emergency releases allow quick disconnection of the transporter 20 to minimize exposure of personnel to radiation should the transporter 20 become contaminated.

For sludge lancing and inspection, the transporter 20 is suspended from the geared support rail 18. For viewing flow slots and tube support plates, the support rail is inverted, and the transporter sits on top of the rail 18. The use of the support rail 18 means that the transporter 18 can be driven directly to a desired intertube gap 86 (FIG. 1), without pausing at intervening intertube gaps 86. Because the transporter 20 does not engage the tubes 88 in the tube bundle 26 during its propulsion along the blow down lane 14, any potential marring of the tubes 88 caused by flexible lance systems which engage the tubes during their travel along the blow down lane is eliminated. Because the transporter 20 does not interact directly with the geometry of the tube bundle 26 for moving along the blow down lane 14, the system 10 can be used with other steam generator designs, with adaptation being accomplished primarily with software changes, rather than hardware changes.

Figure 6:
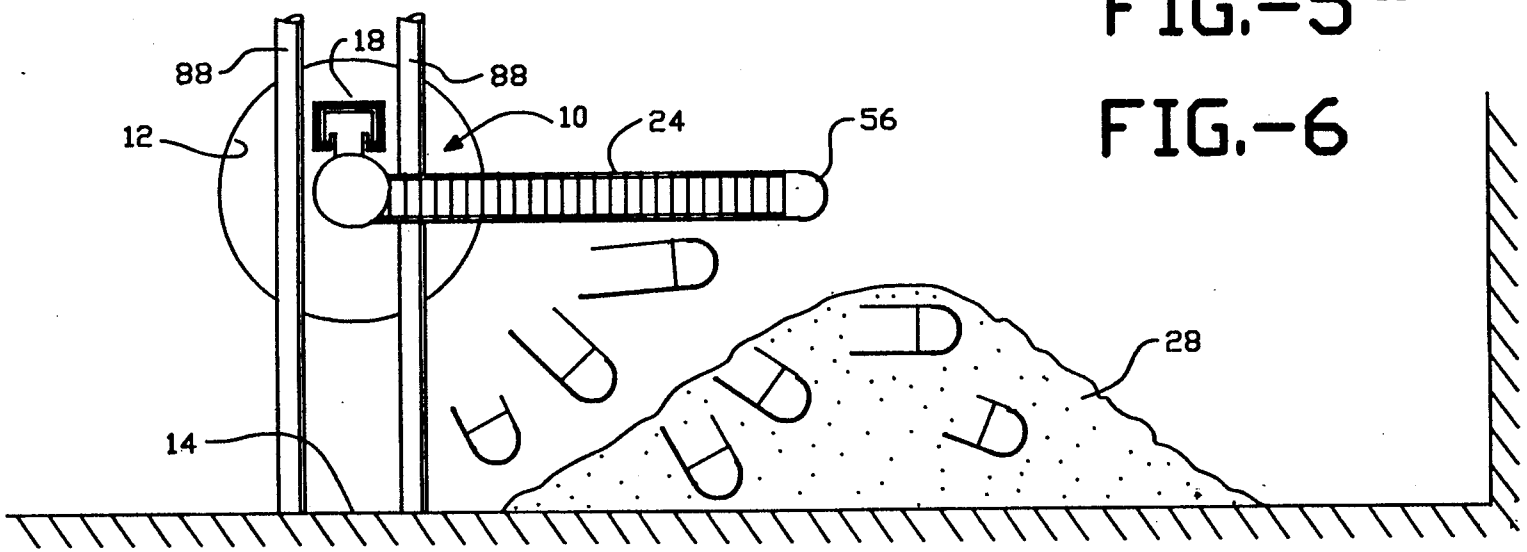
FIG. 6 is a schematic front view of the flexible lance and drive system of FIGS. 1–3 in use.

FIG. 6 schematically shows the positioning advantages obtained both during lancing with jets 60 and during inspection with the VideoProbe camera system 66. The elevation of the transporter 20 so that it is opposite the handhole 12 in the blow down lane 14 allows the flexible lance 24 to approach sludge deposits 28 of varying height angling down from the transporter 20, thus facilitating removal of the deposits 28. The elevation of the transporter 20 also allows the flexible lance 24 to be extended for observation behind the tallest sludge piles 28 likely to be encountered in practice.

The rail 18 also allows the flexible lance 24 to access the closest intertube gaps 86 to the hand hole 12. This is done by having the transporter 20 extend only part wat through the handhole 12, with the nozzle block 56 opposite the intertube gap 86 it is desired to enter with the flexible lance 24.

It should further be apparent to those skilled in the art that various changes in form and details of the invention as shown and described may be made. It is intended that such changes be included within the spirit and scope of the claims appended hereto.

What is claimed is :

1. A system comprising, in combination, a flexible means for accessing an assembly having a difficult to access geometry, a transporter for said flexible means for accessing, means in said transporter for extending said flexible means for accessing from said transporter, a fixed drive rail extending from an access hole of the difficult to access geometry, and at least one transporter drive means connected between said transporter and said drive rail to drive said transporter along said fixed drive rail, said flexible means for accessing comprising a plurality of integrally formed hosebar supports, each comprising a pair of separate, longitudinally extending shapes engaging the separate shapes of adjacent hosebar supports and together defining flexible, longitudinally extending strips and a plurality of bars joining said pair of shapes, said plurality of bars each having at least one correspondingly positioned aperture, and at least one fluid carrying hose extending along said pair of strips through the apertures of said plurality of bars, and a pair of flexible support members, each extending lengthwise through corresponding ones of each pair of the engaging separate, longitudinally extending shapes.

2. The system of claim 1 in which said transporter drive means comprises a rack and pinion, said rack extending along said drive rail and said pinion being rotatably mounted on said transporter.

3. The system of claim 1 in which said drive rail is configured to mount said transporter suspended from said drive rail.

4. The system of claim 3 in which said drive rail is further configured to mount said transporter on top of said drive rail.

5. The system of claim 1 in which said means for extending said flexible means for accessing comprises a sprocket drive and said flexible means for accessing includes a plurality of holes positioned for engagement by said sprocket drive.

6. The system of claim 1 in which said at least one fluid carrying hose includes a high paressure liquid hose and a gas line.

7. The system of claim 1 in which said flexible means for accessing includes an optical cable extending along said pair of strips through correspondingly positioned ones of the apertures of said plurality of bars.

8. A system comprising, in combination, a flexible means for accessing a tube gap, and a transporter for moving said flexible means in the tube gap, said flexible means for accessing comprising a plurality of separate, integrally formed hosebar supports, each comprising a pair of separate, longitudinally extending shapes engaging the separate shapes of adjacent hosebar supports and together defining flexible, longitudinally extending strips and a bar joining said pair of shapes, said bar having at least one correspondingly positioned aperture with respect to apertures in bars of the adjacent hosebar supports, and at least one fluid carrying hose extending along said plurality of hosebar supports through the apertures of said plurality of bars, and a pair of flexible support members, each extending lengthwise through corresponding ones of each pair of the engaging separate, longitudinally extending shapes.

9. The system of claim 8 in which said at least one fluid carrying hose includes a high pressure liquid hose and a gas line.

10. The system of claim 8 in which said flexible means for accessing includes an optical cable extending along said pair of strips through correspondingly positioned ones of the apertures of said plurality of bars.

11. A flexible means for accessing a difficult to access geometry, which comprises a plurality of integrally formed hosebar supports, each comprising a pair of end members forming, together with separate end members of remaining ones of said plurality of hosebar supports, flexible, longitudinally extending strips and a bar joining said pair of end members, said bar having a first correspondingly positioned aperture with respect to first apertures in bars of the adjacent hosebar supports and said pair of end members having a second aperture extending longitudinally through a first one of said pair of end members and a third aperture extending longitudinally through a second one of said pair of end members, a first fluid carrying hose extending along said plurality of hosebar supports through the first apertures of the bars of said plurality of hosebar supports, and first and second structural safety cables respectively extending along said pair of strips through the second and third apertures of each said pair of end members.

12. The flexible means for accessing a difficult to access geometry of claim 11 additionally comprising a fourth correspondingly positioned aperture in each of said bars and a second fluid carrying hose extending along said pair of strips through the fourth apertures of said bars.

13. The flexible means for accessing a difficult to access geometry of claim 12 in which said first fluid carrying hose is a high pressure liquid hose and said second fluid carrying hose is a gas line.

14. The flexible means for accessing a difficult to access geometry of claim 12 in which said flexible means for accessing includes a fifth correspondingly positioned aperture in each of said plurality of bars and an optical cable extending along said pair of strips through the fifth apertures of said plurality of bars.

15. The flexible means for accessing a difficult to access geometry of claim 12 in which said flexible means for accessing terminates in a nozzle block, said nozzle block having a first group of high pressure orifices connected to said first fluid carrying hose and a second group of high pressure orifices connected to said second fluid carrying hose.

16. The flexible means for accessing a difficult to access geometry of claim 11 in which said flexible means for accessing includes a plurality of holes positioned for engagement by a sprocket drive.

17. The flexible means for accessing a difficult to access geometry of claim 11 in which said integrally formed support is a plastic.

18. The flexible means for accessing a difficult to access geometry of Claim 12 in which said integrally formed support is nylon.

19. The flexible means for accessing a difficult to access geometry of claim 11 in which said pair of end members each comprise a bead shape having curved ends,with the curved ends of each of the bead shapes abutting the curved ends of adjacent ones of the bead shapes.

20. The flexible means for accessing a difficult to access geometry of claim 19 in which the bead shapes are faceted.

* * * * *